United States Patent [19]

Mitchell

[11] 4,142,815

[45] Mar. 6, 1979

[54] CONCRETE SLAB STRIKER

[76] Inventor: David C. Mitchell, P.O. Box 541, Burley, Id. 83318

[21] Appl. No.: 855,788

[22] Filed: Nov. 28, 1977

[51] Int. Cl.[2] ..... E01C 19/28

[52] U.S. Cl. ..... 404/103; 404/122

[58] Field of Search ..... 404/103, 117, 124, 131, 404/122

[56] References Cited

U.S. PATENT DOCUMENTS

| | | | |
|---|---|---|---|
| 910,073 | 1/1909 | Lischke | 404/119 |
| 1,302,275 | 4/1919 | Ashmore | 404/124 |
| 1,364,604 | 1/1921 | Ashmore | 404/117 |
| 1,364,605 | 1/1921 | Ashmore | 404/117 |
| 1,626,879 | 5/1927 | Shidler | 404/124 |
| 1,736,413 | 11/1929 | Lichtenberg | 404/103 |
| 2,025,703 | 12/1935 | Baily | 404/117 |
| 3,515,043 | 6/1970 | Austin | 404/103 |
| 3,605,577 | 9/1971 | Bik | 404/122 |
| 3,801,211 | 4/1974 | Perkins | 404/75 |

*Primary Examiner*—Nile C. Byers, Jr.

*Attorney, Agent, or Firm*—Lowe, King, Price & Becker

[57] ABSTRACT

A concrete slab striker employs a counter-rotating roller to grade or strike off the surface of a freshly poured concrete slab while the concrete is still in the plastic state. An elongated roller is supported on a form bordering the concrete slab in engagement with the concrete surface. A manually movable support frame and pull device coupled to opposite ends of the roller allow workmen to pull the roller across the concrete slab. Simultaneously, the roller is rotated in a direction opposite to its direction of travel relative to the surface of the concrete slab. A thin coating of hardened concrete particles accumulates on the roller to impart a texturized surface to the concrete slab when cured.

1 Claim, 3 Drawing Figures

CONCRETE SLAB STRIKER

FIELD OF THE INVENTION

The present invention relates to an apparatus and method for grading the surface of plastic materials, and, more particularly, to a concrete slab striker which employs a counter-rotating roller to strike off the surface of a plastic concrete slab.

BACKGROUND OF THE INVENTION

In the fabrication of concrete slabs, e.g., pavement, sidewalks, driveways, patios and floors, it has been customary to manually perform the grading and finishing operations after the concrete is initially poured to achieve a desired surface finish on the concrete slab. Typically, the grading and finishing work is accomplished by hand operated screeds or trowels. The necessary manual operations has made grading and finishing of concrete surfaces especially time consuming and expensive.

Although techniques have been previously proposed to utilize roller devices to grade and finish concrete surfaces, such techniques have not gained widespread acceptance. These techniques typically employ a roller intended to roll along the concrete surface as the roller is pushed or pulled across the concrete slab. Since there is a tendency for the roller to sink into the concrete, such techniques have not been appropriate to use on freshly poured concrete. Thus, it has been necessary to continue to initially grade freshly poured concrete by hand. Further, even after the concrete has been partially cured, the rolling action of the roller has tended to roughen the concrete surface. Again, it has been necessary to use a substantial amount of manual effort with trowels to subsequently smooth the concrete surface to the desired finish. Consequently, the previous roller techniques have not been able to substantially reduce the time required and cost to grade and finish concrete slabs.

OBJECTIVES OF THE INVENTION

A primary object of the present invention is to provide a technique for striking off and grading the surface of a concrete slab which significantly reduces the time required and expense of grading and finishing concrete surfaces.

Another object of the invention is to provide a concrete slab striker which employs a counter-rotating roller to grade the surface of a plastic concrete slab.

An additional object is to provide a method of striking off the surface of a plastic concrete slab by moving an elongated roller across the surface of the concrete slab while imparting a counter rotation to the roller in an opposite sense to the direction of travel of the roller.

BRIEF DESCRIPTION OF THE INVENTION

The invention is embodied in a concrete slab striker comprising an elongated roller for engaging the surface of the concrete slab to be graded, a form bordering the concrete slab and adapted to support the roller in engagement with the concrete surface, means for moving the roller across the form and over the concrete surface, and means for rotating the roller as it is moved across the form in a direction opposite to the direction of travel of the roller. Preferably, the concrete slab striker includes a manually movable support frame connected to one end of the roller and a manual pull device coupled to the opposite end of the roller to facilitate manual movement of the roller across the form. In the preferred embodiment, a motor is mounted on the support frame and connected to drive the roller. In addition, a reverse switch is mounted on the support frame and coupled to the motor to permit the direction of rotation of the roller to be reversed.

The concrete slab striker of the present invention allows a freshly poured concrete slab to be immediately graded. The counter-rotating roller permits the concrete slab striker to rapidly grade a concrete slab and provide a level surface without low spots and high spots. In contrast to prior manual grading techniques with screeds or trowels, the time required to complete the desired grading is substantially reduced. In addition, the use of the counter-rotating roller achieves a texturized surface on the concrete slab which may, if desired, be left in tact or subsequently smoothed by further manual operations with hand trowels.

The rotation of the roller in the concrete slab striker of the present invention occurs at a relatively high rate of spin in comparison with the mere rolling motion of the roller devices in the prior art. The high speed spin tends to avoid a thick accumulation of concrete particles on the roller and consequent disturbances of the concrete surfaces. In contrast to the prior art, only a thin coating of concrete particles accumulates on the roller. This thin coating produces a relatively smooth, texturized surface in comparison with the roughened concrete surfaces achieved in the prior art. Accordingly, the time required for any additional manual finishing of the concrete slab is minimal.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE PREFERRED EMBODIMENT

Figures 1, 2, 3:
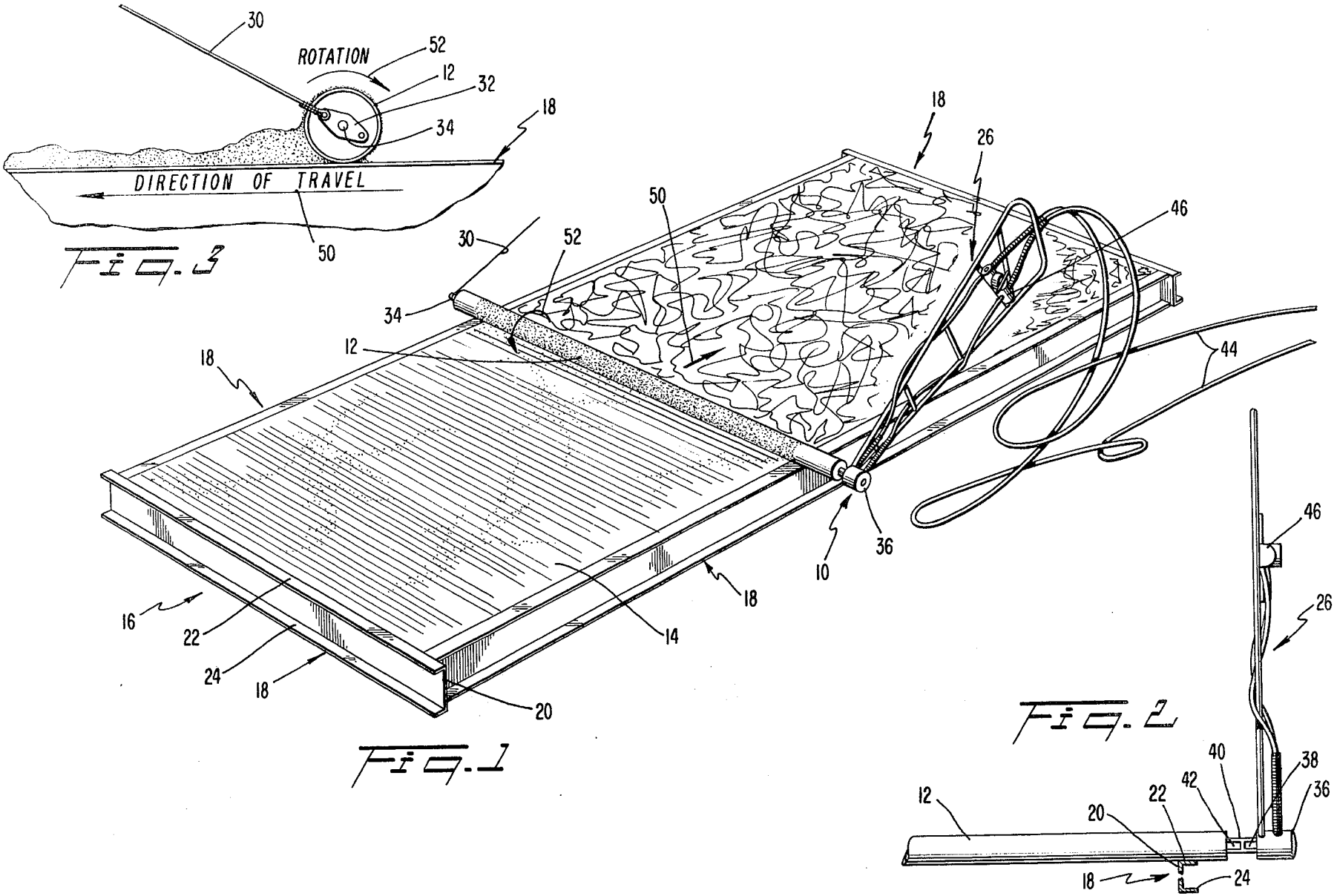
FIG. 1 is a perspective view of a concrete slab striker embodying a counter-rotating roller in accordance with the invention.
FIG. 2 is an enlarged front view of one end of the roller illustrating a manually movable support frame and a hydraulic motor and reversible motor control switch mounted on the support frame.
FIG. 3 is an enlarged side view of the opposite end of the roller illustrating a manual pull device coupled to the roller.

Referring to FIG. 1, a concrete slab striker, generally 10, includes an elongated roller 12 for engaging the surface of a concrete slab 14 to be graded. Preferably, roller 12 comprises a length of steel tubing, e.g., 5 inch O.D., 10 gauge tubing. The interior of the roller may be filled with concrete for additional weight.

A form, generally 16, bordering concrete slab 14 is provided to define and hold the shape of the concrete slab while it is poured and cured. Preferably, the form comprises a plurality of elongated channel-shaped guide members 18 located at the edges of the concrete slab. Each channel-shaped guide member includes an upright wall 20 for engaging the adjacent edge of the concrete slab, a horizontal flange 22 at the top of the wall for engaging and supporting roller 12, and a lower flange 24 at the bottom of the wall.

In accordance with the invention, means is provided for moving the roller across the form and over the concrete surface. Preferably, this means is embodied as a manually movable support frame 26 connected to one end of roller 12. Support frame 26 is comprised of a plurality of tubular metal elements and is appropriately shaped for convenient handling by a workman to control the movement of the corresponding end of roller 12. In addition, a manual pull device 30 is coupled to the opposite end of roller 12. As shown in FIG. 3, pull device 30 comprises a rope or cord secured to a bearing member 32 which rotatably receives a shaft 34 rigidly connected to the end of roller 12. The pull cord is intended for use by an additional workman to control the movement of the opposite end of the roller.

In accordance with the invention, the concrete slab striker includes means for rotating the roller as it is moved across the form in a direction opposite to the direction of travel of the roller. Referring to FIGS. 1 and 2, the preferred embodiment includes a hydraulic motor 36 mounted at the lower end of support frame 26. The motor includes an output shaft 38 connected by a sleeve 40 to a shaft 42 rigidly secured to roller 12. Hydraulic fluid is supplied under pressure to motor 36 via a pair of fluid supply lines 44 connected to a pressurized fluid source (not shown) and a reverse switch 46 mounted on support frame 26. Switch 46 includes forward, stop, and reverse positions to control the direction of flow of hydraulic fluid to motor 36 and the direction of rotation of motor output shaft 38 and roller 12.

In operation of the concrete slab striker, guide members 18 are initially set up to provide form 16 which defines the desired size and shape of the concrete slab. Although a rectangular form is shown, it will be understood that different shapes can be used. Then, the form is filled with freshly poured concrete. Next, roller 12 is placed on top of the guide members 18 along opposite edges of the concrete slab to support the roller in engagement with the upper surface of the concrete slab. A first workman grips support frame 26 and a second workman grips pull cord 30 to draw roller 12 in the direction of travel indicated by arrow 50 (FIGS. 1 and 3). Simultaneously, switch 46 is actuated to supply pressurized hydraulic fluid to motor 36 and rotate roller 12 in a direction of rotation indicated by arrow 52 in an opposite sense to the direction of travel of the roller.

As shown in FIG. 3, the movement of roller 12 along guide members 18 tends to level or grade the upper surface of the concrete slab. Excess concrete is driven in front of the roller to fill in low spots where additional concrete is required. The result is a level surface on the concrete slab without low or high spots. In addition, a thin coating of concrete particles accumulates on roller 12 and imparts a texturized surface to the concrete slab as the roller is moved along guide members 18.

The rate of spin imparted to roller 12 is relatively high in comparison with the speed of travel of the roller over the concrete surface. Thus, there is a tendency for the roller to resist the pulling forces exerted by the workmen on support frame 26 and pull cord 30. In addition, the roller tends to slip on flanges 22 of the guide members as it is pulled in the direction indicated by arrow 50.

When the roller arrives at one end of the concrete slab, switch 46 is activated to stop hydraulic motor 36. With the roller remaining in place on guide members 18, support frame 26 and pull cord 30 are turned over to pull the roller in the opposite direction of travel. Simultaneously, switch 46 is activated to reverse the direction of rotation of roller 12 as it is pulled toward the other end of the concrete slab. Thus, a counter rotation is again imparted to roller 12 in an opposite sense to the direction of travel of the roller over the concrete surface.

The grading operation achieved by roller 12 produces a texturized surface on the concrete slab which may be left in tact if a roughened finish is desired . However, in the event that a smooth surface is required, additional finishing operations may be performed with manual trowels to smooth the concrete surface.

In this disclosure, there is shown and described only the preferred embodiment of the invention, but, as aforementioned, it is to be understood that the invention is capable of use in various other combinations and environment and is capable of changes or modifications within the scope of the inventive concept as expressed herein.

What is claimed is:

1. A concrete slab striker for grading the surface of a plastic concrete slab, comprising:

an elongated roller for engaging the surface of the concrete slab to be graded;

a form bordering said concrete slab and adapted to support said roller in engagement with the concrete surface;

a manually movable support frame connected to only one end of said roller to allow push-pull control of the roller by one man from the side of said form;

a motor mounted on said support frame and connected to drive said roller, said motor for rotating said roller as it is moved across said form in a direction opposite to the direction of travel of said roller;

a reverse switch mounted on said support frame and coupled to said motor to permit the direction of rotation of said roller to be reversed;

a manual pull device coupled to the opposite end of said roller to allow auxiliary pull control of the roller.

* * * * *